US006988700B2

(12) United States Patent
Cote

(10) Patent No.: US 6,988,700 B2
(45) Date of Patent: Jan. 24, 2006

(54) ANCHOR BRACKET FOR POST

(76) Inventor: Victor Cote, 200, Industriel, St-Apolinaire, Quebec (CA), G0S2E0

( * ) Notice: Subject to any disclaimer, the term of this patent is extended or adjusted under 35 U.S.C. 154(b) by 0 days.

(21) Appl. No.: 10/833,592

(22) Filed: Apr. 28, 2004

(65) Prior Publication Data

US 2004/0211876 A1 Oct. 28, 2004

Related U.S. Application Data

(60) Provisional application No. 60/465,520, filed on Apr. 28, 2003.

(51) Int. Cl.
*F16M 13/00* (2006.01)

(52) U.S. Cl. ..... 248/519

(58) Field of Classification Search ..... 248/519, 248/511, 500, 507; 411/84, 372.5; 52/296; 403/6, 7, 187–189; 256/65.14
See application file for complete search history.

(56) References Cited

U.S. PATENT DOCUMENTS

| | | | | | |
|---|---|---|---|---|---|
| 3,552,698 | A | * | 1/1971 | Kinney | 248/158 |
| 4,367,864 | A | | 1/1983 | Eldeen | |
| 4,793,111 | A | | 12/1988 | Shewchuk | |
| 5,143,472 | A | | 9/1992 | Reed et al. | |
| 5,568,909 | A | | 10/1996 | Timko | |
| 5,873,671 | A | | 2/1999 | West | |
| 5,960,601 | A | | 10/1999 | Offutt | |
| 6,015,138 | A | * | 1/2000 | Kohlberger et al. | 256/65.14 |
| 6,141,928 | A | | 11/2000 | Platt | |
| 6,213,452 | B1 | | 4/2001 | Pettit et al. | |
| 6,324,800 | B1 | | 12/2001 | Valentz et al. | 52/298 |
| 6,336,620 | B1 | | 1/2002 | Belli | |
| 6,508,457 | B1 | | 1/2003 | Knudson et al. | |
| 6,672,017 | B2 | | 1/2004 | Larson | 52/170 |
| 6,712,330 | B1 | | 3/2004 | Damiano | 248/519 |
| 2002/0040956 | A1 | | 4/2002 | Carnahan et al. | 248/188.8 |

* cited by examiner

*Primary Examiner*—Ramon O Ramirez

(57) ABSTRACT

An anchor bracket for post having the possibility of offering from four to twelve anchor fastening points meant for anchoring a variety of types of mechanical fasteners depending upon the surface material upon which it is to be installed.

4 Claims, 1 Drawing Sheet

ANCHOR BRACKET FOR POST

Figure 1:
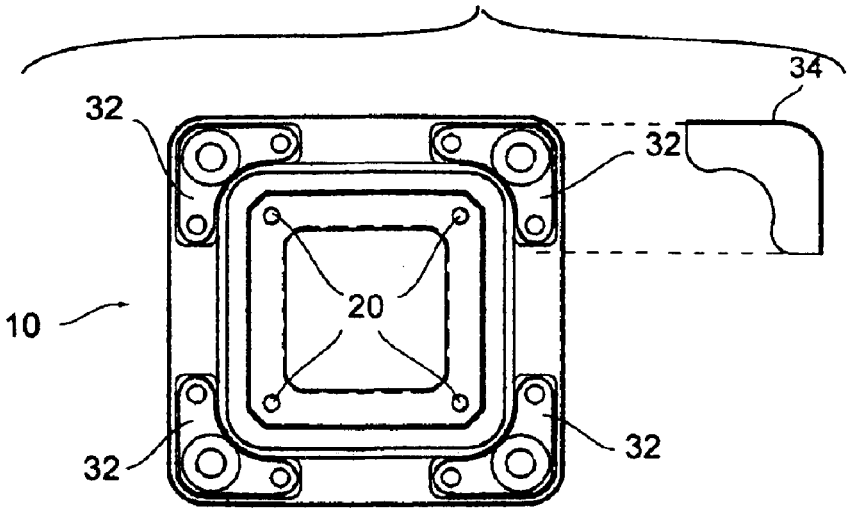

This application claims priority based on provisional application 60/465,520 filed Apr. 28, 2003

BACKGROUND OF THE INVENTION

1. Field of the Invention

This invention relates generally to anchoring means but more particularly to an anchor or base for a post.

2. Background

The prior art reveals several different mounting brackets or anchors meant for receiving a post. Some are designed for receiving rough posts for fences where there is no need for refinement and nails or screws can be placed where they are clearly visible since aesthetic values are unimportant. In situations where a nice railing is desired such as around a porch or a balcony, a more refined look is desired but often at the cost of a less sturdy anchor. Because a railing can be installed over a variety of surfaces, some more solid than others, one type of anchor may not be solid on all types of surface.

Currently, the best type of anchor is a die-cast aluminum square piece having four holes for screws which are in line with four small footings that provide clearance for water and moisture so that there is no trapped moisture. The post is generally mechanically fastened from underneath the anchor prior to its installation. Once the post is fixedly attached to the anchor, the anchor is positioned and fixedly attached to the surface by way of four corner screws or bolts. The screws or bolts are left to be apparent.

There is therefore a need for a better more universal anchor bracket for post.

SUMMARY OF THE INVENTION

The present invention consists of an anchor offering the possibility of having from four to twelve holes, meant for mechanical fasteners, depending upon the level of strength needed. Also, once the mechanical fasteners are installed, because the base of the anchor is deep, all the mechanical fasteners can be hidden using small caps designed to cover the mechanical fasteners and blend in with the overall appearance of the anchor in order to provide for a clean finished look. Since sturdiness of the anchor is more than doubled, it can result in the use of fewer posts in a railing. A judicious choice in the thickness of the anchor; the positioning and the size of the holes; the shape of the access porthole leading to the holes that have to deal with issues of freezing and thawing; and the provision for a practical snap on cap—all of these elements make this instant invention more than just an obvious improvement over the prior art The foregoing and other objects, features, and advantages of this invention will become more readily apparent from the following detailed description of a preferred embodiment with reference to the accompanying drawings, wherein the preferred embodiment of the invention is shown and described, by way of examples. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE PREFERRED EMBODIMENT

FIG. 1 Top view of the anchor bracket.

Figure 2:
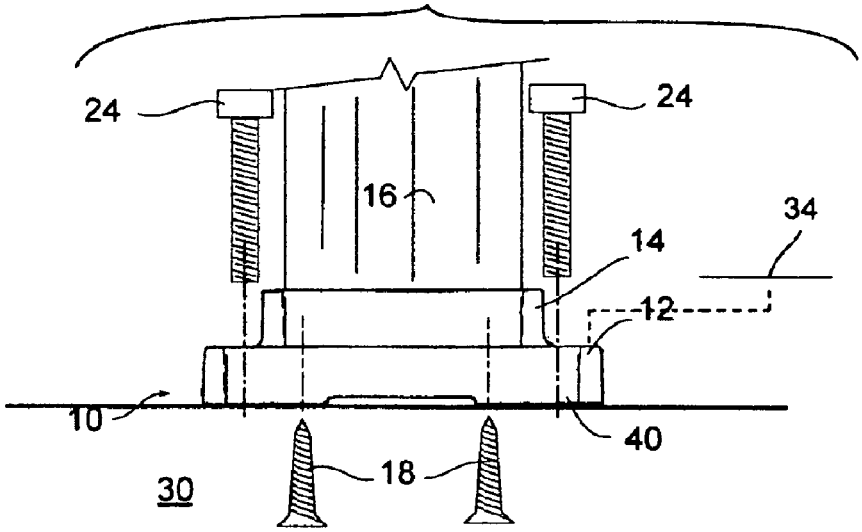

FIG. 2 Side view of the anchor bracket.

Figure 3:
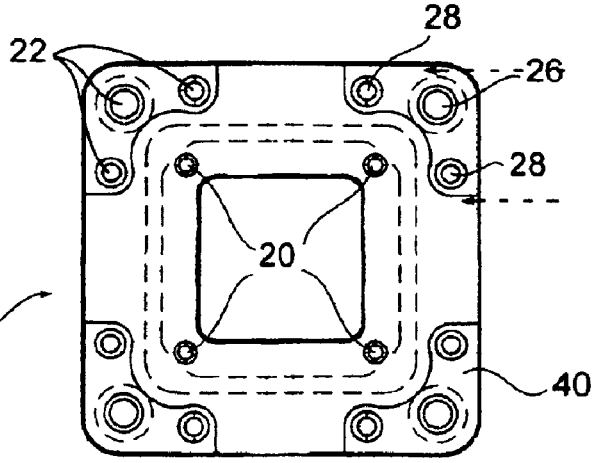

FIG. 3 Bottom view of the anchor bracket and a cap.

DETAILED DESCRIPTION OF THE PREFERRED EMBODIMENT

An anchor bracket for posts (10) has a base (12) and a chimney (14) into which a post (16) is to be inserted. As is common in the industry, the post (16) is mechanically fastened to the anchor bracket (10) by passing mechanical fasteners (18) through post fastening holes (20) and into the post prior to setting the base (12) on a surface (30). Small footings (40) at each of the four corners of the base (12) raise the base (12) slightly in order to allow for air circulation, as is known in the art.

Once the post (16) is mechanically fastened to the base (12), the base (12) can be positioned at the desired location on a surface (30). This is where the anchor bracket (10) distinguishes itself from anchors of the prior art: Since the anchor bracket (10) can be installed on a variety of surfaces (30), ranging from aspenite to fiberglass to concrete by way of plywood and plastic boards, different levels of fastening are required to provide for a similar degree of strength across the various materials use for the surface (30). Thus, the anchor bracket (10) offers the possibility of having from four to twelve anchor fastening points meant for anchoring anchor mechanical fasteners (24) depending upon the surface (30) material to be used.

The anchor fastening holes (22) are grouped inside four access portholes (32) in groups of three in each access portholes (32). Each access porthole (32) has a main hole (26) and two alternate holes (28) arranged in an "L" shaped configuration. The main holes (26) can receive larger anchor mechanical fasteners (24) such as, but not limited to, bolts with washers and nuts or bolts adhesively bonded to concrete, while the alternate holes (28) receive comparatively smaller anchor mechanical fasteners (24) such as, but not limited to, screws. Any type of combination can be had with mixed anchor mechanical fasteners (24) installed in various arrangements such as. For example, all anchor fastening holes (22) filled on a side of the anchor bracket (10) that is close to the edge of the surface (30) while leaving empty fastening holes (22) on the opposite side, all dependend upon the characteristics of the surface (30).

Once the anchor mechanical fasteners (24) are installed, because the base (12) of the anchor bracket (10) is deep, all anchor mechanical fasteners (24) are sufficiently recessed to allow for the access portholes (32) to be optionally covered with a cap (34) to seal said access portholes (32) and which provides for a clean, smooth, finished look for the anchor bracket (10). Since sturdiness is more than doubled by the use of additional anchor mechanical fasteners (24), it can result in the use of fewer posts (16) in a railing.

What is claimed is:

1. An anchor bracket for posts having a post mechanically fastened to said anchor bracket by passing mechanical fasteners through post fastening holes and into said post prior to setting a base on a surface; small footings at each of four corners of said base to raise said base in order to allow for air circulation; having a base and a chimney into which said post is to be inserted and having the following improvement:

anchor fastening holes grouped inside four access portholes in groups of three in each said access portholes;

each said access porthole having a main hole and two alternate holes arranged in an "L" shaped configuration;

said main holes and said alternate holes receiving mechanical fasteners.

2. An anchor bracket for posts as in claim 1 wherein:

said main holes receiving anchor mechanical fasteners such as bolts with washers and nuts or bolts adhesively bonded to concrete.

3. An anchor bracket for posts as in claim 1 wherein:

said alternate holes receiving anchor mechanical fasteners such as screws.

4. An anchor bracket for posts as in claim 1 wherein:

a cap covers said access portholes.

* * * * *